United States Patent [19]

Young, Jr. et al.

[11] 4,217,682

[45] Aug. 19, 1980

[54] WEB EDGE DECURLING DEVICE AND METHOD FOR USING SAME

[76] Inventors: William O. Young, Jr., 116 Marlin Dr., Spartanburg, S.C. 29302; Mansel A. Jennings, Rte. 3, Box 349, Inman, S.C. 29349

[21] Appl. No.: 855,373

[22] Filed: Nov. 28, 1977

Related U.S. Application Data

[63] Continuation of Ser. No. 675,305, Apr. 9, 1976, abandoned.

[51] Int. Cl.[2] ..... D06C 25/00

[52] U.S. Cl. ..... 26/98

[58] Field of Search ..... 26/88, 98, DIG. 1, 87

[56] References Cited

U.S. PATENT DOCUMENTS 4,821 10/1846 Carlisle ..... 26/87 X

FOREIGN PATENT DOCUMENTS 276759 7/1914 Fed. Rep. of Germany ..... 26/DIG. 1
105895 5/1917 United Kingdom ..... 26/DIG. 1
117427 7/1918 United Kingdom ..... 26/DIG. 1

*Primary Examiner*—Robert Mackey
*Attorney, Agent, or Firm*—Luke J. Wilburn, Jr.; Wellington M. Manning, Jr.

[57] ABSTRACT

A device for engagement with a moving web to remove curl, fold or crease from an edge thereof. Opposite banks of elongated stationary fins are angularly disposed with respect to the direction of movement of the web and are spaced apart to define a predetermined web passageway therethrough. The edge of the traveling web passes between the banks of fins and cooperative forces produced by the opposing banks of the elongated angularly disposed fins remove curl from the edge of the web as well as removing folds and creases. In a preferred embodiment, the elongated fins have opposite taper at leading and trailing ends to permit proper feeding of a web therebetween and to permit location of the device in close proximity to adjacent web handling equipment. In another preferred embodiment, the two banks of elongated fins are operatively associated under spring tension, whereby adjustment may be made between banks of fins while damage to a web passing therethrough or to the device is substantially alleviated.

18 Claims, 9 Drawing Figures

WEB EDGE DECURLING DEVICE AND METHOD FOR USING SAME

CROSS REFERENCE TO RELATED APPLICATION

This application is a continuation of application Ser. No. 675,305 filed Apr. 9, 1976 in the name of William O. Young, Jr. and Mansel A. Jennings for Web Edge Decurling Device And Method For Using Same, now abandoned.

BACKGROUND OF THE INVENTION

Textile webs in general are subject to curling along an edge or selvage thereof when being handled and often have pressed folds or creases thereat. In order to produce a compact roll of goods or to achieve proper web handling along a process line for printing, inspection, drying, extraction of moisture, washing, doubling, tacking or other web treatment, it is desirable and sometimes necessary to insure that the web is in a flat condition, with little or no fabric deformation being present at either selvage during handling. Proper package preparation or web handling may thus be achieved in conjunction with apparatus of the present invention that engages the web selvage and due to a particular action, removes curl, folds and creases the selvage of the web. While the device of the present invention is suitable for curl, fold and crease removal, hereinafter the term "decurling" only will be used for all.

Several different classes of decurling devices have heretofore been developed that include static as well as power driven approaches. Known static systems include a pair of spring loaded elements that are disposed above and below the web, with each of the elements being U shaped where a short leg of the U is presented on the web side and engages the web so as to strip curl therefrom. A further static structure includes a planar surface having ridges disposed thereon over which the web passes, with frictional forces produced between the web and the ridges attempting to remove curl from the selvage of the web. Many of the web edge decurlers in commercial operation are of a driven type where oppositely disposed discs, rotating fingers, screws, belts or the like are located along a selvage of the web. The elements are driven to produce a motion which, in turn, imparts a spreading effect on the web to remove curl along the selvage of same. Likewise, air jets have been directed against web curl to cause an uncurling of the selvage.

All of the aforementioned prior art decurling devices are expensive, bulky, and/or are limited as to deployment due to physical size or construction. Further, the driven units require a high energy consumption and operating cost. The decurling device of the present invention represents a definite advance in the art, and is specifically discussed hereinafter.

SUMMARY OF THE INVENTION

It is an object of the present invention to provide a device for removing curl, folds and the like from the edge of a moving web.

Another object of the present invention is to provide a static device for flattening the selvage of a traveling web to provide a uniform web surface thereat.

Yet another object of the present invention is to provide a device for decurling an edge of a moving web that may be positioned immediately adjacent further-in-line processing equipment.

Still another object of the present invention is to provide an improved device for removing curl, folds and the like from the selvage of a moving fabric web to improve the processability of the web.

Generally speaking, the present invention relates to a device for treating an edge of a traveling web to remove curl, folds and the like therefrom comprising a first bank of elongated fins disposed above an edge of a path of travel for said web, said fins being arranged at an angle with respect to an edge of a web traveling thereunder, and a second bank of elongated fins disposed beneath said edge of said path of travel for said web, said banks of fins being set to define a particular web passageway therethrough, said second bank of elongated fins being arranged at an angle with respect to an edge of a web traveling thereover, whereby a web passing therethrough will have curl, folds and the like removed therefrom to provide a flat web thereat.

More specifically, the device of the present invention is a unit where two banks of elongated spaced apart angularly disposed fins are adjustable to provide an overlap or a predetermined gap therebetween. Spring loaded at the particular relative positions, the two banks of fins cooperate and act on a web traveling therebetween to spread the web in a direction transverse to the direction of web travel to a point where any curl along the selvage of the web is removed.

Since the installed device is a static structure, no maintenance problems are inherent therewith. Likewise, initial cost of the device is small compared to the initial cost of certain of the prior art driven units for removing curl from selvage of a traveling web. The device also may be adjusted to provide a wider gap at the entrance end than at the exit end for certain webs whereupon curl is progressively removed along the angular length of the fins of the device.

A further feature for consideration is that the elongated fins are preferably tapered at a leading end for ease of web entry into the device. An element taper away from the plane of the oncoming web assists in guiding the web between the banks of fins. Likewise, a taper may be provided along a trailing end of the elongated fins of the device, which permits the unit to be located immediately adjacent a nip defined by a pair of rolls, a roll and a planar surface, or other processing equipment. Hence, after removal of curl from a selvage of a traveling web, the web can be immediately engaged by adjacent equipment before the curl can return. In this manner, processability of a traveling web is improved or the web may wound into a roll without any end distortion due to curl, folds or the like therein.

In one arrangement along a process line, a web feed means may be provided to supply a source of web. The feed means is located upstream from the decurling device while a suitable web take-up means is located downstream of the decurler. Obviously, other processing equipment may be interspersed along the web line as desired. In fact, the decurling device of the present invention may be submerged in a finishing range, may be located on a simple fabric batcher, may be used on a tenter frame just ahead of the pins, may be used in conjunction with a pad, an extractor, print machines, doublers, tackers, and the like.

The method according to the present invention comprises the general steps of providing a web feed means and web take-up means; feeding a web from said feed means to said take-up means along a predetermined path of travel; engaging said fabric on a top and bottom of same adjacent a selvage of same along said path of travel with a plurality of spaced apart angularly disposed elongated fins, said fins being angled in a direction to direct any curl along the selvage towards an outer edge thereof, whereby said curl is removed from the selvage of the traveling web.

While a wide range of webs may be flattened by the device of the present invention, a proper setting of the device removes curl, folds and the like without instituting any longitudinal tension in the web or picking of the web. Moreover, the fins of the decurler unit may be hardened or otherwise treated to handle abrasive webs without any adverse effects thereto. Likewise, a proper adjustment of the decurling device enables the removal of curl, folds and the like without producing any web bulge at the entrance to the device. The web being flattened is preferably fed through the decurler unit in a straight line at both the entrance and exit ends of same.

DESCRIPTION OF THE PREFERRED EMBODIMENTS

Figure 1:
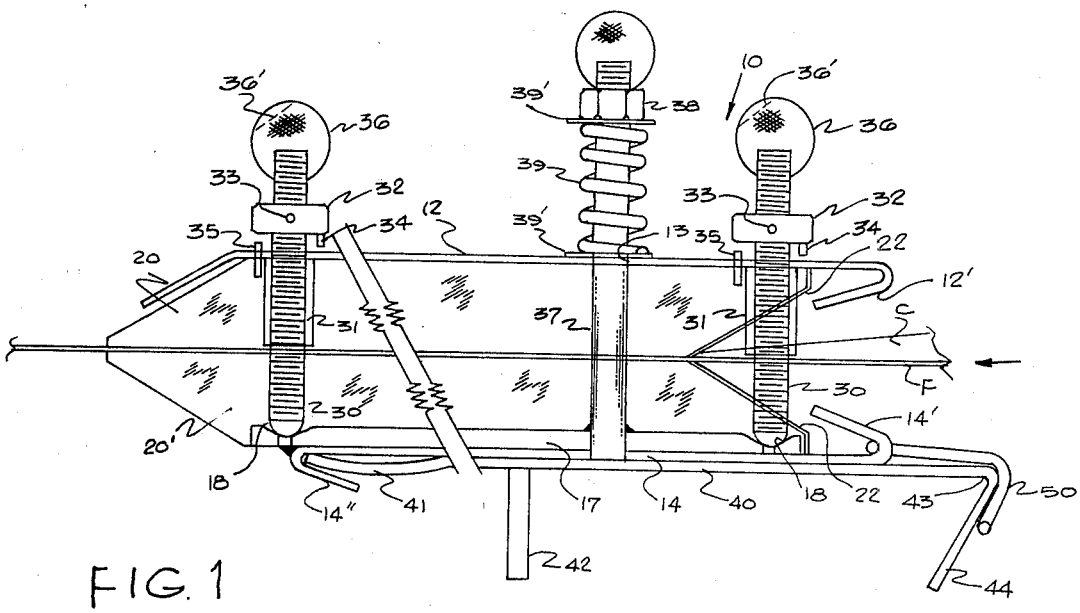
FIG. 1 is a side cross sectional view of a segment of a web decurler according to the teachings of the present invention.

Referring to the Figures, preferred embodiments of the present invention will now be described in detail. FIG. 1 illustrates an edge decurler according to the present invention generally indicated as 10 and having a fabric indicated as F passing therethrough. Note that upstream of decurler 10 a slight roll or curl C appears along the fabric edge which is removed by decurler 10 as illustrated by a flat fabric appearance downstream of decurler 10.

Figure 6:
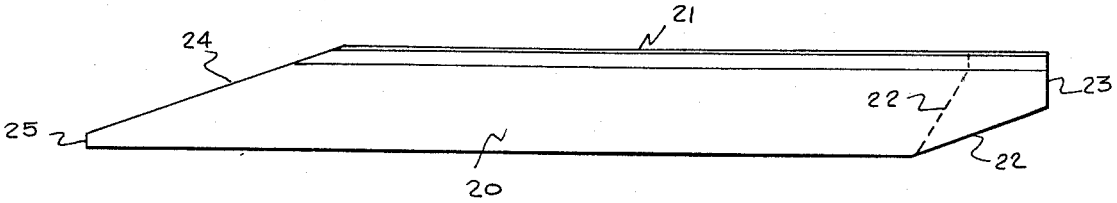
FIG. 6 is a side view of a fin of a decurler unit of the present invention.
Figure 7:
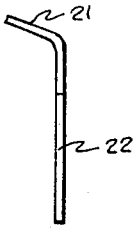
FIG. 7 is an end view of the fin illustrated in FIG. 6.
Figure 9:
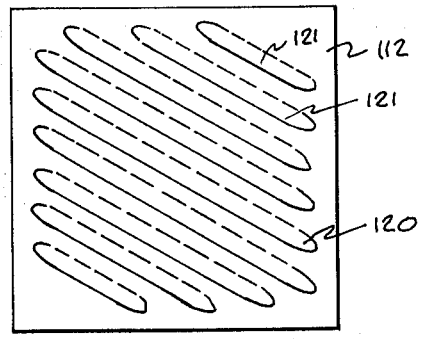
FIG. 9 illustrates a further embodiment of decurler elements according to the present invention.

Decurler 10 as illustrated in FIG. 1, has a top cover 12 and a bottom cover 14. Top cover 12 has a plurality of elongated elements or fins 20 secured therealong in an angular arrangement such that the elements are directed towards an outer edge of a fabric path of travel. As will be described in more detail hereinafter, a plurality of elongated fins 20 are deployed in side by side generally parallel fashion. Further elongated fins 20' are secured to bottom 14 in like fashion to those secured to top 12. As illustrated in FIGS. 6 and 7, elongated elements 20 and 20' may be represented by singular members 20 having a flange 21 extending outwardly therefrom. A leading end of element 20 has a bevel 22 along a portion thereof extending upwardly to a shoulder 23. The angle of bevel 22 may differ depending upon the type of web being handled. For example, the angle shown may be suitable for a knitted web while for a woven web, the angle of bevel 22 may be as illustrated in phantom in FIG. 6. Likewise, in an opposite direction, the trailing end of element 20 may be provided with a bevel 24 down to a shoulder 25 or may be square. All of the edges of element 20 that encounter a web passing thereby are smooth to avoid damage to the web. The particular embodiment of element 20, as illustrated in FIGS. 6 and 7, is secured to its appropriate portion of the decurler unit 10 by a weldment or the like. Flange 21 may, for example, be welded to upper cover 12 or to bottom 14 as is required. Conversely, as is illustrated in FIG. 9, a single plate 112 may be employed having a plurality of elements 120 die cut therefrom in part such that the elements may be pressed downwardly to bend at the edges 121 that are integral with plate 112. In this fashion, all of the individual elements of the unit are integral along the top and bottom sections respectively. Shape and disposition of the elements 120 as pressed from plate 110 are dictated only by the techniques for cutting elements 120 from plate 110. Thereafter, if necessary, the edges of the elements 120 may be deburned, buffed or the like so as to remove any rough spots therefrom that could damage a web passing thereby.

In the sense of the present invention, while a plurality of elements are recited throughout the specification and claims, it is intended that the plurality of elements or fins may be cut from a single plate with the elements being unitized along the top and bottom of the unit or that singular elements as described in FIGS. 6 and 7 may be individually secured to an appropriate plate. Furthermore, other variations of the elements could likewise be possible.

With the elements 20, 20' properly secured to top 12 and bottom 14, decurler unit 10 may be assembled by use of threaded bolts 30 which extend downwardly through sleeves 31 that are secured to the underside of top plate 12 and have threads complementary to those on bolts 30. Bolts 30 thus extend downwardly and are received in a dished out area 18 of a base 17 to limit in one direction the gap settings of unit 10. Bolts 30 may have an adjustment nut 32 received therearound and locked in place by a set screw 33 or the like. A stop pin 34 is secured to nut 32 and depends downwardly therefrom. A further stop pin 35 is secured to plate 12 and extends upwardly therefrom, being located in a path of travel of pin 34. Bolts 30 are then limited in rotational movement of any setting of adjustment nut 32 whereby adjustment of fins 20 and 20' are limited at said setting. Should a greater adjustment be required for device 10, adjustment nut 32 can be moved along bolt 30 to permit such further adjustment. Bolts 30 further have a thumb head or the like 36 at an upper end thereof for grasping same for adjustment. Thumb heads 36 preferably further have indicia means 36' such as a groove therein as a reference so that all of the bolts 30 can be maintained at a common adjustment if desired.

A threaded element 37 is also employed for adjustment of unit 10 and is secured to a base 17 by welding or the like. Element 37 extends upwardly through an opening 13 in plate 12 that is provided therefor. A lock nut arrangement 38 is provided atop top cover 12 along with a compression spring 39 to continually apply force against a pair of flanges 39' received therearound. Bolts 30 are thus preset so as to secure unit 10 from one direction. Thereafter, with the lock nut 38 preset in accordance with bolts 30, compression spring 39 maintains spring pressure on the decurling unit. With the adjustment means just described for decurler 10, fins 20 and 20' can be preset with a definite gap between the respective lower edges of same, or may be moved together for an interference fit where a web passing therebetween is forced to follow a tortuous path. In any event, the setting for the decurler unit depends upon the particular web being handled. In the sense of a textile web, a primary use of the present invention is found in treating textile webs where a wide range of materials may be handled, extending from very delicate tricot fabrics to heavy double knit fabrics.

Making further reference to FIG. 1, note that the beveled areas 22 on the entrance end of unit 10 cooperate insofar as top and bottom elements are concerned to define a V shaped entrance path for the fabric web F to enter unit 10. In like fashion, top and lower covers 12 and 14 respectively, are provided with inturned flanges 12' and 14' which likewise further assist in defining an entrance to unit 10. As a web passes through unit 10, the angular presentation of elements 20, 20' causes the curl, fold or the like C to move outwardly towards an adjacent selvage and to be removed from the web. As will be described in more detail hereinafter, the trailing edges 24 of elements 20 and 20' may be beveled or flat to permit decurler unit 10 to be located immediately adjacent a nip or the like to permit further handling of fabric F after being treated by decurler unit 10 and preclude any return of curl C along the selvage.

Figure 2:
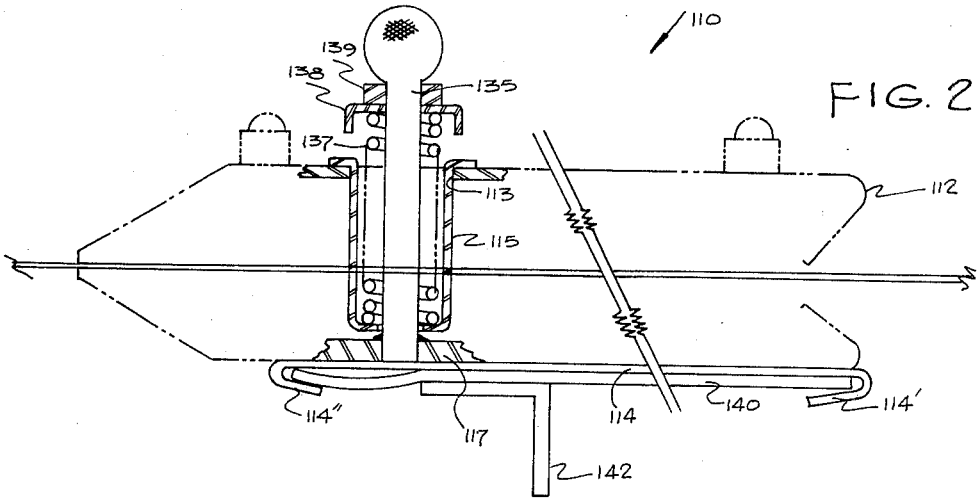
FIG. 2 is a side elevational view of a further embodiment of an edge decurler of the present invention.

FIG. 2 shows a further embodiment of a decurler unit generally indicated as 110 according to the present invention. In FIG. 2, top cover 112 has a larger opening 113 adjacent an outer edge with a cup 115 being received therein around a threaded element 135. Threaded element 135 is secured to base 117 in like fashion as seen in FIG. 1 and has a spring 137 received therearound. A cover 138 is received at an upper end of spring 137 and has a nut 139 received around threaded element 135. Spring 137 may be compressed by movement of nut 139 in an appropriate direction to provide spring tension for the same purposes as set forth in FIG. 1. This particular embodiment is more compact than that of FIG. 1, reducing the height of threaded element 37.

Figure 3:
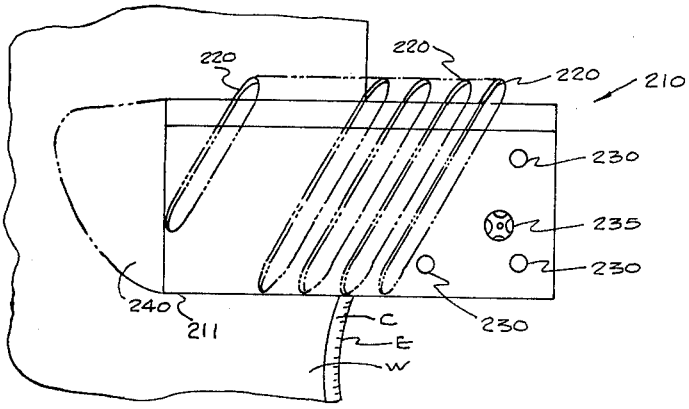
FIG. 3 is a plan view of an embodiment of an edge decurler according to the teachings of the present invention.

FIG. 3 illustrates an edge decurler 210 positioned above a web W that is passing therethrough in the direction of the arrow. Note that decurler unit 210 extends outwardly beyond an edge E of web W. Note further that fins 220 are angled in a direction such that curl along edge E of web W is forced outwardly towards the outer edge E thereof. In the embodiment shown in FIG. 3, the upper plate 212 is provided with three threaded elements 230 in the fashion of FIGS. 1 and 2. Elements 230 are in the shape of a triangle with a spring threaded rod arrangement 235 of either FIG. 1 or FIG. 2 therewithin. The decurler unit 210 of FIG. 3 illustrates a particular embodiment of a mounting means therefor. A web support plate 240 is secured to an underside of decurler 210 and holds the web away from an edge 211 of the decurling unit in those situations where there is no intermediate support for web W. For example, decurler 210 could be utilized on the arms of a tenter frame, located just prior to the pins. A fabric being fed to the tenter frame could thus be provided for securement on the pins in a flat condition, whereby waste is avoided.

Figure 4:
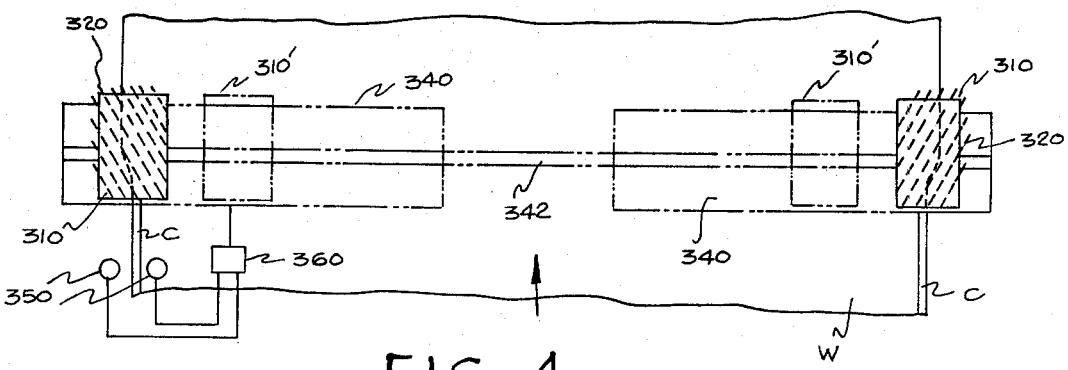
FIG. 4 is a schematic view of a segment of traveling web showing edge decurlers located along both selvages of same and removing curl from the web.

In practicing the present invention, webs of different widths would obviously be encountered. As such, making reference to FIGS. 1, 2 and 4, width adjustment for the decurler unit will be described. Mounting bars 40, 140 and 340, respectively, may be provided and secured to a suitable frame member 42, 142 and 342, respectively. FIG. 1 shows a rear end 14" of bottom 14 that extends around a corresponding edge 41 of support 40. Opposite edge 43 of support 40 is provided with a downward leg 44 which receives a suitable holding means 50 secured to end 14' of bottom 14. As shown in FIG. 2, bottom 114 of decurler 110 may have opposite ends both turned inwardly at 114' and 114" to fit around mounting bracket 140 which is supported by framework 142. In the embodiments shown in FIGS. 1 and 2, mounting brackets 40 and 140 can be made of a flexible plastic material or the like such that upon a snap fitting relationship, the plastic support 140 will be bowed to exert lateral forces at the appropriate ends 14' and 14" or 114, 114" to securely hold the decurler unit in place. The mounting brackets do not necessarily extend completely across the width of the web path. Instead, as shown in FIG. 4, supports 340 terminate intermediate the length of frame 342, leaving an intermediate portion free for the removal of decurling units 310. Hence, decurling unit 310 may be moved laterally along its support 340 inwardly or outwardly to a desired location depending upon the width of web W being handled thereby.

FIG. 4 illustrates two decurling units 310 located along opposite edges of a web W that is passing in the direction of the arrow. Note that decurler units 310 have a plurality of angularly presented fins 320 engaging a web W having curl C therein as illustrated to remove the curl and flatten the web to its normal width.

Also shown in phantom in FIG. 4, are a second set of decurling units 310' which are inwardly disposed along mounting brackets 340. The tandem units 310' may be useful in performing the function of an edge guide. In this regard, with the units in place and a web passing therebetween, an actuation of pressure against same will reduce clearance between the banks of fins and provide a driving force which will cause the web to move in the direction of the particular unit where the pressure is actuated. As such, the tandem units 310' serve the dual purpose of removing creases and the like from the web as well as serving as a guide for the edge of the web. Pressure actuating means for initiating web movement to properly associate the edge of the web with the decurler 310 is operatively associated with the detector means in a fashion commonly used in the art. Schematically illustrated are a pair of photocells 350 that are connected to a control system 360 which, in turn, is connected to the decurling units 310'. Once web deviation is sensed, control system 360 actuates the particular unit 310' that is needed to return web W to its proper position. Also if necessary, an opposite action may be produced on the decurler opposite the direction of movement. A web edge detector system may be utilized in conjunction with any of the embodiments of the present invention along with a converter system to keep the edge of the web in the decurler unit.

Figure 5:
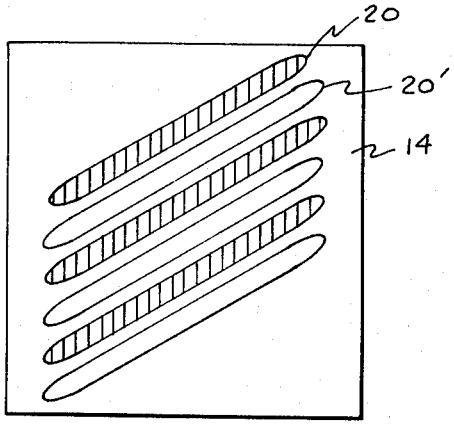
FIG. 5 is a schematic plan view of an edge decurler according to the present invention showing a particular fin placement embodiment.

FIG. 5 illustrates a plurality of fins 20 in plan cross section. The fins 20' are secured to a bottom cover 14 while the fins 20 would be secured to a top cover (not shown). In the arrangement shown in FIG. 5, the fins are not vertically aligned, but are offset from each other in a vertical plane and may be canted. Upper and lower covers may be positioned with sufficient closeness to each other such that a tortuous passageway is produced between adjacent fin edges to apply sufficient frictional contact against web W to cause the curl, fold or the like to be removed therefrom. Since certain fabrics are more prone to curl than others and certain fabrics are more difficult to decurl than others, it is desirable to have adjustable decurler units according to the present invention. In this regard, a proper way of adjustment for general operation is to bring opposing fins together until slight binding occurs when a sheet of paper is pulled through the unit. There is thus operative association between the upper and lower fins to remove curl from the web in an expeditious fashion.

Figure 8:
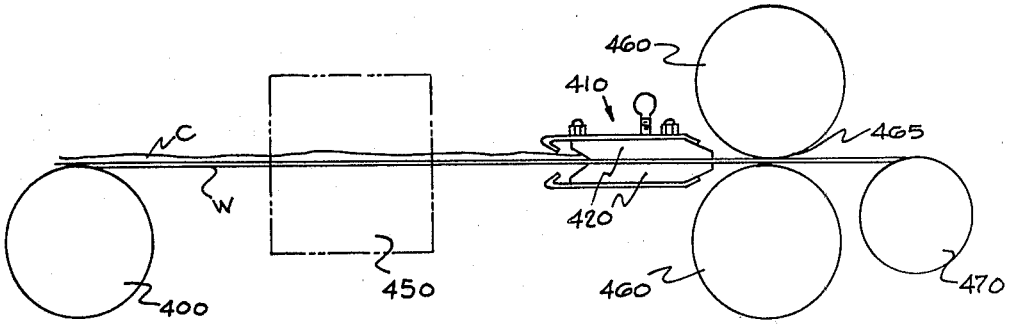
FIG. 8 is a schematic illustration of a simplified process utilizing edge decurlers according to the present invention.

The general process according to the present invention is illustrated in FIG. 8 along with a further embodiment of the physical attributes of the decurler unit. A roll 400 is symbolically illustrative of a feed means for a web W. The particular type feed means is not limited to a roll, but could be any suitable source of web supply. A phantom illustrated block 450 is symbolic of intermediate operations, if any, as may be necessary for any textile or other web handling system. Along the line of web travel are located a pair of rolls 460 that define a nip 465 therebetween. Subsequent to the nip rolls 460 is a web take-up 470. Note in handling of the web W, a thickened area indicated by C that represents curl along an edge of a fabric that extends into a decurling unit 410. Symbolically illustrative of decurling unit 410 are a pair of fins 420 as are used to produce same. Note that the trailing end of the unit 410 that is disposed adjacent the nip 465 finds the fins 420 tapered to permit a disposition immediately at the nip. Hence, once the curl C is removed from the web W by the unit 410, and the web immediately passes into the nip 465 between opposing rolls 460, there is no opportunity for the curl to return to the web. Instead of a nip 465 between two opposing rolls 460, any web take up, processing or other means may be immediately adjacent the decurler unit 410.

Having described the present invention in detail, it is obvious that one skilled in the art will be able to make variations and modifications thereto without departing from the scope of the invention. Accordingly, the scope of the present invention should be determined only by the claims appended hereto.

What we claim is:

1. A device for removing curl, folds and the like from an edge of a moving web comprising:

(a) a top plate, said plate having a plurality of parallel fins associated therewith, said fins including a first flange section associated with said plate generally parallel to a path of web travel through said device and a second elongated section secured to and angularly offset from said first section and extending downwardly therefrom generally transverse to a path of web travel through said device, an outer free edge of said second elongated section of said fins having a smooth angled surface for contact with said web;

(b) a bottom plate, said bottom plate having a plurality of parallel fins associated therewith, said fins having a first flange section associated with said plate generally parallel to a path of web travel through said device and a second elongated section secured to and angularly offset from said first section and extending upwardly therefrom generally transverse to said path of web travel, an outer free edge of said second elongated section of said fins having a smooth angled surface for contact with said web; and fins being located immediately adjacent and offset from the vertical planes of said fins associated with said top plate whereby said outer free edges of said elongated second sections of said top and bottom fins define said web passageway therebetween, said top and bottom fins being disposed at an angle to an edge of a web traveling thereby; and (c) adjustment means associated with said plates to set said fins at a predetermined relationship.

2. A device as defined in claim 1 wherein said adjustment means comprises a plurality of threaded elements receivable through one of said plates and contactable with the other of said plates, and spring means positioned outside and in contact with said one of said plates, said spring means applying a force on said one plate biasing same toward said other of said plates.

3. A device as defined in claim 1 wherein said top and bottom fins are set to provide a tortuous web path therebetween.

4. A device as defined in claim 1 wherein said second section of said top and bottom fins is tapered at a rear end toward said web passageway whereby said device may be positioned immediately adjacent further processing equipment.

5. A device as defined in claim 4 wherein the opposite end of said second sections of said top and bottom fins tapers away from said web passageway to define an entrance to said device.

6. A device as defined in claim 1 wherein said bottom plate has device mounting means secured thereto.

7. A device as defined in claim 1 wherein said top fins and said bottom fins are spaced apart further on a leading end than on a trailing end.

8. A device as defined in claim 1 wherein said fins are of unitary construction with said plate for same, whereby said first section of said fins forms a part of said plate.

9. A device as defined in claim 1 wherein said top and bottom fins are individual elements secured to the respective plates for same.

10. A device as defined in claim 1 wherein the top and bottom fins are canted toward an outer edge of a web traveling thereby.

11. An edge decurling device for a moving web comprising:

(a) a first bank of parallel enlongated fins, said fins having a first flange section generally parallel to a path of web travel through said device and a second elongated section angularly offset from said first section and depending outwardly therefrom in a direction generally transverse to said path of web travel, said fins having a downward bevel on a leading edge, an outer free edge of said second elongated section of said fins having a smooth angled surface for contact with said web;

(b) a second bank of parallel elongated fins, said fins having a first flange section generally parallel to said path of web travel and a second elongated section angularly offset from said first section and extending outwardly therefrom in a direction generally transverse to said path of web travel, an outer free edge of said second section of said fins having a smooth angled surface for contact with said web, said second bank of fins having an upward bevel on a leading edge and being located immediately adjacent and offset from the vertical planes of said first bank of fins, said outer free edges of said second elongated sections of said fins defining said web passageway, and said bevels on said leading edges of said fins serving as a guide into said web passageway;

(c) adjustment means for said fins to determine the height of said web passageway;

(d) spring means for holding said banks of fins under spring tension when adjusted; and (e) mounting means for securing said device along a web path of travel.

12. An edge decurling device as defined in claim 11 wherein each of said banks of said fins is of unitary construction.

13. An edge decurling device as defined in claim 11 wherein said adjustment means comprise three bolts located in triangular configuration at an outer end of said unit.

14. An edge decurling device as defined in claim 13 wherein said spring means comprises a coil spring.

15. An edge decurling device as defined in claim 11 wherein said fins are canted in a direction of the leading edges of same.

16. A method for removing curl, folds and the like from a traveling web of knit material comprising the steps of:

(a) providing a pair of opposite banks of elongated static fins, one bank being above said web and the other bank below said web, said fins of each bank being parallel and angularly presented with respect to a path of web travel, said fins including a first flange section that extends generally parallel to said path of web travel and a second elongated section that is angularly offset from said first section and extends generally transverse to said path of web travel, said generally transverse elongated fin section having a smooth angled surface along an outer free edge of same for contacting said web, said fins of one bank being offset from the vertical planes of fins of said other bank and said banks of fins being preadjusted such that the outer free ends of said generally transverse elongated sections provide a web passageway therebetween; and (b) passing an edge of said web between said banks of fins and engaging said web with said smooth angled surfaces of said outer free ends of said elongated sections of said fins, whereby curls, folds and the like are removed from said web without creating any substantial longitudinal web tensions.

17. The method as defined in claim 16 wherein said banks of fins are provided along both edges of said web.

18. An edge decurling device for a moving web comprising:

(a) a top plate, said plate having a plurality of parallel elongated fins associated therewith, said fins being disposed at an angle to an edge of a web passable thereby, said fins further having smooth surfaces thereon for all web contact areas;

(b) a bottom plate, said bottom plate having a plurality of parallel elongated fins associated therewith, said fins being disposed at an angle to an edge of a web passable thereby, said fins having smooth surfaces thereon for all web contact areas, said fins associated with said bottom plate being located immediately adjacent and offset from vertical planes of said fins associated with said top plate, whereby said fins define a web passageway therebetween;

(c) a plurality of sleeves secured to an underside of said top plate adjacent an end of same outside an edge of the fabric path thereby, and a threaded element received in each said sleeve and contacting said bottom plate, each said threaded element having a nut received thereon above said top plate, whereby adjustment may be made to the passageway defined by said fins, said top plate further having a stop means thereon adjacent each said threaded element and the nut on each said threaded element has a stop means thereon whereby space adjustment between said fins is limited; and (d) a further threaded element secured to said bottom plate adjacent an end of same outside an edge of the web passageway thereby and extending upwardly through said top plate, said threaded element having a nut therearound located above said top plate and having a spring means received therearound and located between said nut and said top plate.

* * * * *

UNITED STATES PATENT AND TRADEMARK OFFICE

CERTIFICATE OF CORRECTION

PATENT NO. : 4,217,682

DATED : August 19, 1980

INVENTOR(S) : William O. Young, Jr., Mansel A. Jennings

It is certified that error appears in the above-identified patent and that said Letters Patent are hereby corrected as shown below:

Column 8, claim 1, line 4, "and" should read--said--.

Signed and Sealed this

*Second* Day of *December 1980*

[SEAL]

*Attest:*

SIDNEY A. DIAMOND

*Attesting Officer*

*Commissioner of Patents and Trademarks*